US007552587B2

(12) United States Patent
Galligan

(10) Patent No.: US 7,552,587 B2
(45) Date of Patent: Jun. 30, 2009

(54) DEFLECTOR PLATE TO ENHANCE FLUID STREAM CONTACT WITH A CATALYST

(75) Inventor: Michael Patrick Galligan, Cranford, NJ (US)

(73) Assignee: BASF Catalysts LLC, Florham Park, NJ (US)

( * ) Notice: Subject to any disclaimer, the term of this patent is extended or adjusted under 35 U.S.C. 154(b) by 286 days.

(21) Appl. No.: 11/050,383

(22) Filed: Feb. 3, 2005

(65) Prior Publication Data

US 2006/0171866 A1 Aug. 3, 2006

(51) Int. Cl.
*F01N 7/00* (2006.01)

(52) U.S. Cl. ..... 60/324; 60/274; 60/299; 60/302

(58) Field of Classification Search ..... 60/299, 60/301, 302, 324, 274
See application file for complete search history.

(56) References Cited

U.S. PATENT DOCUMENTS 4,222,236 A * 9/1980 Hegedus et al. ..... 60/274
5,373,119 A * 12/1994 Suzuki et al. ..... 181/230
5,521,339 A * 5/1996 Despain et al. ..... 181/230
5,722,237 A * 3/1998 Iida et al. ..... 60/302
5,738,184 A * 4/1998 Masuda et al. ..... 181/262
5,808,245 A 9/1998 Wiese et al. ..... 181/255
5,857,327 A * 1/1999 Sato et al. ..... 60/302
6,109,026 A * 8/2000 Karlsson et al. ..... 60/302
6,341,662 B1 * 1/2002 Karlsson ..... 181/230
6,393,835 B1 * 5/2002 Stoll et al. ..... 60/299
6,684,628 B2 * 2/2004 Gobel et al. ..... 60/277
6,837,335 B2 * 1/2005 Jankowski ..... 181/243
6,935,461 B2 * 8/2005 Marocco ..... 181/270
7,032,709 B2 * 4/2006 Hoche et al. ..... 181/268
7,156,202 B2 * 1/2007 Assad ..... 181/258
2002/0128151 A1 9/2002 Galligan et al.
2004/0038819 A1 2/2004 Galligan et al.
2004/0087439 A1 5/2004 Hwang et al.

* cited by examiner

*Primary Examiner*—Tu M Nguyen
(74) *Attorney, Agent, or Firm*—Stuart D. Frenkel; Frenkel & Associates, P.C.; Melanie L. Brown

(57) ABSTRACT

A low-cost catalytic article is provided for treating gaseous fluid streams such as exhaust streams from gasoline-powered engines. The articles contain residence chambers defined by chamber walls and foraminous catalytic elements that contain a catalyst composition for converting a reactant contained in the fluid stream, and deflectors, which increase the residence time of the fluid stream in the residence chamber and the contact time of the fluid stream with the catalytic element.

18 Claims, 5 Drawing Sheets

DEFLECTOR PLATE TO ENHANCE FLUID STREAM CONTACT WITH A CATALYST

The present invention relates to low cost catalytic articles and methods for treating a fluid stream, e.g., a gaseous fluid stream. Among other things, the articles and methods disclosed herein are well suited for converting pollutant components in exhaust streams produced by small engines to innocuous components. The exhaust gases of internal combustion engines, including small engines, are known to contain pollutants such as hydrocarbons, carbon monoxide and nitrogen oxides (NOx) that foul the air.

More stringent emission regulations for devices powered by small internal combustion engines are increasingly being mandated by various regulatory agencies. By small engines, it is meant that the engines, usually two-stroke and four-stroke spark ignition engines, have a displacement of less than about 75 and preferably less than 35 cubic centimeters. Such engines ("utility engines") are found, in particular, in gasoline-engine powered lawn mowers, motorized chain saws, portable generator units, snow blowers, grass/leaf blowers, string mowers, lawn edgers, garden tractors, motor scooters, motorcycles, mopeds, and like devices. Such engines provide a severe environment for a catalytic exhaust treatment apparatus. This is because in small engines, the exhaust gas contains a high concentration of unburned fuel and unconsumed oxygen. Since the users of many of such devices (e.g., motorized saws, lawn mowers, string cutters) work in close proximity to the devices, the concern for reducing the emissions is heightened.

Exhaust treating catalyst articles offer one solution toward reducing emissions from devices powered by small engines. However, practical integration of catalytic articles into such devices can be difficult because the operating conditions for small engines pose difficult design challenges.

First, the catalyst article must be durable. In comparison to devices powered by larger engines (e.g., an automobile), devices powered by smaller engines are less able to absorb and diffuse the vibrations caused by the engine. The vibrational force in a two-stroke engine can be three or four times that of a four-stroke engine. For example, vibrational accelerations of 70G to 90G (G=gravitational acceleration) at 150 hertz (Hz) have been reported for small engines. The harsh vibration and exhaust gas temperature conditions associated with small engines lead to several modes of failure in the exhaust gas catalytic treatment apparatus, including failure of the mounting structure by which a catalyst member is secured in the apparatus and consequential damage or destruction of the catalyst member due to the mechanical vibration and to flow fluctuation of the exhaust gas under high temperature conditions. In addition, small engines provide less design flexibility with regard to the placement of the catalytic article. In devices powered by small engines, the close proximity of the catalytic article to the engine exposes the article to intense vibrations. Furthermore, small engines are characterized by high temperature variations as the load on the engine increases and decreases. Accordingly, a catalyst member used to treat the exhaust of a small engine is typically subjected to greater thermal variation and more vibration than the catalytic converter on an automobile, and these conditions have lead to spalling of catalytic material.

Second, the catalytic articles preferably accommodate high flow rates since the majority of small engine platforms exhibit high space velocities due to the limited size of the mufflers employed on these engines. For instance, a small engine having a displacement of 50 cubic centimeters operating with a maximum of 8,000 rpm typically has an exhaust output of 12,000-15,000 L/h. Catalyst articles that significantly restrict the flow rate of the exhaust stream are less desirable since higher back pressures within the exhaust system reduce the engine's operating efficiency. Moreover, as a result of the high flow rate of exhaust stream through the catalyst article, the catalyst composition employed must be highly active and optimally disposed within the article to ensure adequate pollutant conversions.

Third, the catalyst articles are preferably lightweight and occupy small volumes since many of the devices powered by small engines are handheld tools, e.g., weed trimmers, chainsaws. Excessive weight or unwieldy protrusions from such devices negatively restrict the applications that the devices were designed for.

Fourth, the cost of the emissions treatment system cannot significantly increase the overall cost of the device to ensure that the device remains competitive on the marketplace. Small engines typically power moderately priced devices. Accordingly, a need has arisen to design a catalytic article for treating the emissions of devices powered by small engines which meets expected standards, yet minimizes the added cost to the device.

Catalysts useful in small engine applications are described in U.S. Ser. No. 08/682,247, hereby incorporated by reference. Briefly such catalysts comprise one or more platinum group metal compounds or complexes which can be on a suitable support material. The term "compound", as in "platinum group metal compound" means any compound, complex, or the like of a catalytic component which, upon calcination or use of the catalyst, decomposes or otherwise converts to a catalytically active form, which is often an oxide or metal. Various compounds or complexes of one or more catalytic components may be dissolved or suspended in any liquid which will wet or impregnate the support material.

Suitable support materials include refractory oxides such as alumina, silica, titania, silica-alumina, aluminosilicates, aluminum-zirconium oxide, aluminum-chromium oxide, etc. Such materials are preferably used in their high surface area forms. For example, gamma-alumina is preferred over alpha-alumina. It is known to stabilize high surface area support materials by impregnating the material with a stabilizer species.

The catalytic materials are typically used in particulate form with particles in the micron-sized range, e.g., 10 to 20 microns in diameter, so that they can be formed into a slurry and applied as a washcoat on a carrier member. Suitable carrier members may be employed, such as a honeycomb-type carrier of the type having a plurality of fine, parallel gas-flow passages extending therethrough from an inlet or an outlet face of the carrier so that the passages are open to fluid-flow therethrough. Such honeycomb-type carrier may be made of any suitable refractory material such as cordierite, cordierite-alpha-alumina, silicon nitride, zirconium mullite, spodumene, alumina-silica magnesia, zirconium silicate, sillimanite, magnesium silicates, zirconium oxide, petallite, alpha-alumina and aluminosilicates. Alternatively, a honeycomb-type carrier may be made of a refractory metal such as a stainless steel or other suitable iron-based, corrosion-resistant alloys which can contain aluminum. The coater carrier is disposed in a canister suited to protect the catalyst member and to facilitate establishment of a gas flow path through the catalyst member, as is known in the art.

Commonly assigned U.S. Publication No. 2004/0087439, published May 6, 2004, discloses a catalyzed metallic substrate useful as part of exhaust systems which can be used with small engines for applications such as motorcycles, lawn mowers, chain saws, weed trimmers, and the like.

Commonly assigned U.S. Publication No. 2004/0038819, published Feb. 26, 2004, discloses a pliable refractory metal carrier may have coated thereon an anchor layer to improve adherence to the carrier of a catalytic coating. The conformable catalyst member may be bent to conform to a curved or bent exhaust pipe within which it is mounted.

Commonly assigned U.S. Publication No. 2002/0128151, published Sep. 12, 2002, discloses electric arc spraying a metal onto a substrate to produce an anchor layer on the substrate that serves as a surprisingly superior intermediate layer for a catalytic material deposited thereon. Spalling of catalytic material is resisted even when subjected to the harsh conditions imposed by small engines or in a close-coupled position for a larger engine. It is further disclosed that the catalytic coating can be applied to substrates such as foam, corrugated foils, or screens.

SUMMARY OF THE INVENTION

In accordance with this invention, the exhaust gas from small gasoline powered engines is directed to a catalytic article comprised of a gas residence chamber enclosed at least in part by a catalytic screen and a deflector plate. The deflector plate increases the residence time of the exhaust gases in the residence chamber and improves the catalytic efficiency of the screen. The deflector plate increases the residence time of exhaust gas in the gas residence chamber by causing the exhaust gases to deflect off the plate surface into the chamber instead of exhausting directly through the screen. As a result, the catalytic article requires less catalytic screen, thus lowering the costs. The gas residence chamber can be of annular configuration in the form of a circular screen and deflector plate, or can be rectilinear, in which the screen and deflector plate are linearly disposed between the inlet and the exhaust of the catalytic article.

DETAILED DESCRIPTION OF THE INVENTION

Figure 1:
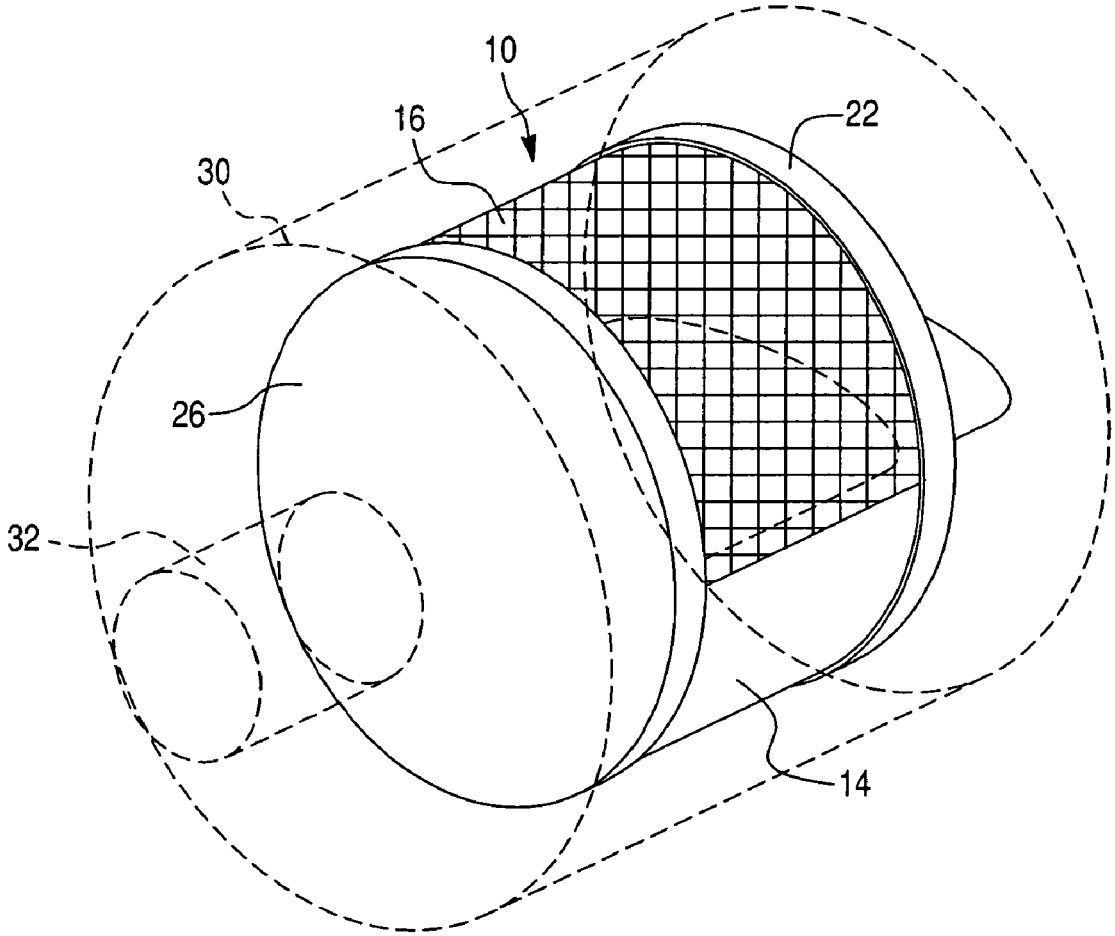
FIG. 1 is a perspective view of one embodiment of the catalytic article of this invention.
Figure 2:
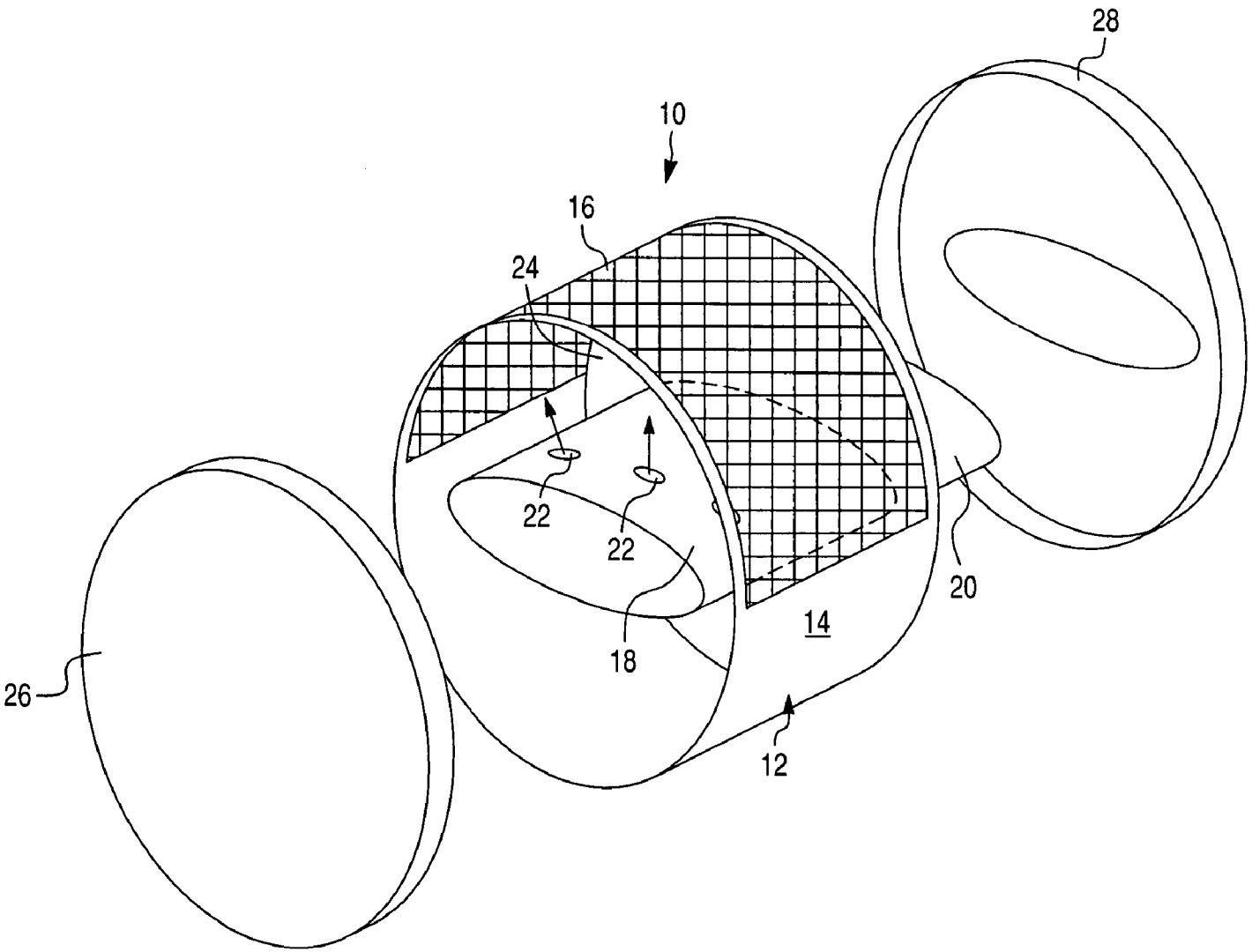
FIG. 2 is an exploded view of the catalytic article of FIG. 1 and having an annular gas residence chamber formed between an inlet/outlet pipe and an outer wall composed of a deflector plate and a foraminous catalytic element.

A catalytic article of this invention, for small engines, is placed within a muffler casing and designated by reference numeral 10 as shown in FIGS. 1 and 2. In this embodiment, the catalytic article 10 comprises cylindrical chamber outer wall 12 composed of a solid deflector plate 14 and a foraminous catalytic element or screen 16. The outer wall 12 is annularly spaced from a conduit 18 having an inlet 20 which receives exhaust gases from a gasoline powered engine (not shown), for example, and outlets 22 spaced around conduit 18 and directing the untreated exhaust gases into the annular space 24 between chamber outer wall 12 and conduit 18. The annular space is characterized as residence chamber 24. The outlets 22 are provided wholly around conduit 18 including the opposite side of the conduit 18 that is not visible in FIG. 2. Thus, residence chamber 24 is defined at least in part by the outer wall of conduit 18 and outer chamber wall 12. In this embodiment of the invention, the residence chamber 24 is further defined by the upper wall 26 and lower wall 28 shown in FIG. 2. Gas flow is directed through outlets 22, into residence chamber 24 and through screen 16, which is coated with a catalytic metal such as a platinum group metal as discussed previously. A portion of the gas passes immediately through the screen 16 and exits muffler casing 30 through outlet 32. Residence time of the exhaust gases in chamber 24 is increased by incorporation of deflector plate 14, which redirects a portion of the gas back into residence chamber 24 and into contact with screen 16. Deflector plate 14 may optionally be at least partially coated with a catalytic layer.

The catalyst composition disposed on the foraminous catalytic element 16 may promote the conversion of hydrocarbons, CO, and/or NOx reactants in the untreated gas stream. As a result of its porosity, the foraminous catalytic element 16 facilitates communication between the residence chamber 24 and the exterior of the article 10. For instance, in the embodiment shown in FIGS. 1 and 2, a non-woven stainless steel wire mesh serves as the substrate that carries the catalyst composition.

As shown in FIG. 2, conduit 18 can be a diffuser block having a plurality of conduit outlets 22 for introducing the exhaust gas stream from an engine into the residence chamber 24. Generally, some of the apertures 22 in the diffuser block 18 direct at least some proportion of the exhaust gas flow in the direction of the deflector plate 14. In addition to directing the exhaust gas stream, the diffuser block 18 provides the article 10 with strength and rigidity.

A description of the operation of catalytic article 10 illustrates one aspect of the inventive method. A fluid stream, typically from a gas source (e.g., an engine exhaust manifold), enters inlet 20, and travels through the conduit 18 into the residence chamber 24, via the conduit outlets 22. The fluid stream has an inlet space velocity. One or more of the conduit outlets 22 direct at least some portion of the fluid stream against the deflector plate 14 to deflect the fluid stream and reduce its space velocity (i.e., to less than the inlet space velocity) through the chamber 24. The reduced space velocity increases the residence time of the fluid stream in the residence chamber 24, and also results in increased contact time with the foraminous catalytic element 16. The fluid stream exits the chamber 24 by passing through the foraminous catalytic element 16.

In the method illustrated by this embodiment, deflection of the fluid stream by the deflector 14 increases the residence time of the fluid stream within the residence chamber 24. While not being bound by any specific theory, it is believed the increased residence time provides more effective contact between the reactant components in the fluid stream with the catalyst composition deposited on the foraminous element than in articles not equipped with deflector plates. Consequently, the increased contact time provides high conversions of the reactants. As a result of the increased residence time, lower overall loadings of active catalyst components (e.g., platinum group metal components) are needed to meet emissions goals than are needed for articles not equipped with deflector plates. This feature provides a significant cost-savings advantage, particularly where the active catalytic component of the composition used are costly, precious metal components, e.g., platinum group metal components. Platinum group metal components, for example, are widely used in catalyst compositions to promote the conversion of unburned hydrocarbons, carbon monoxide and NOx in the exhaust gas from gasoline engines.

In embodiments of the invention where the article is used to treat an exhaust gas from a gasoline engine, a muffler housing 30 may cover the article 10. For instance, the article may vent the treated exhaust fluid stream into the muffler housing 30 and exhaust the gas through outlet 32.

In alternative embodiments of catalytic article 10, conduit 18 need not be axially mounted with respect to the outer chamber wall. For instance, the conduit 18 can enter the article from a radial direction and can have one or more outlets that allow communication between the residence chamber 24 and the conduit.

Figure 3:
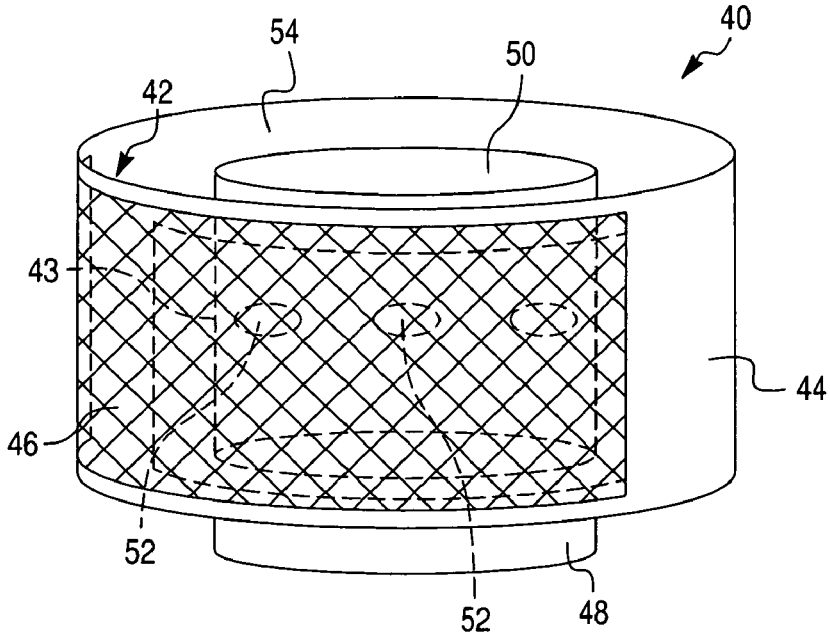
FIG. 3 depicts a plan view of an alternative catalytic article containing a deflector plate within the annular space of the gas residence chamber.
Figure 4:
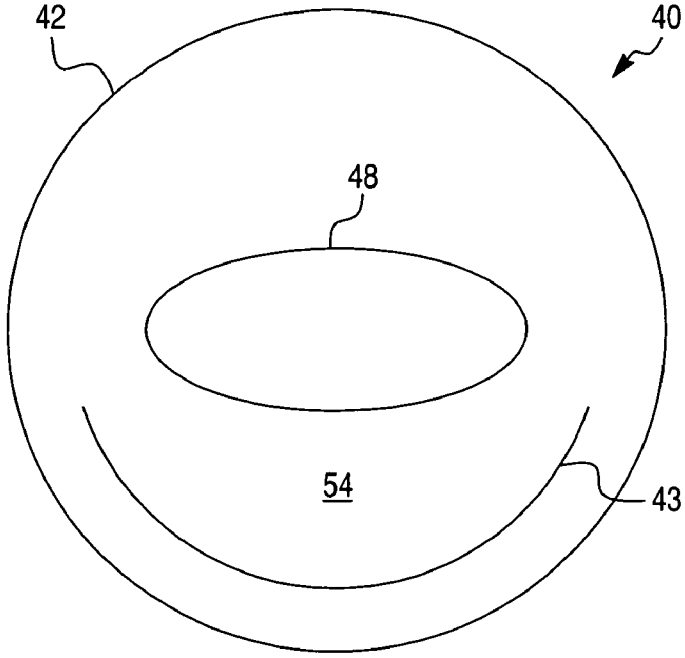
FIG. 4 shows a top view of the catalytic article of FIG. 3.

In an alternative embodiment to the catalytic article 10 as shown in FIG. 2, the article 10 may contain one or more additional deflectors within the residence chamber. For instance, FIGS. 3 and 4 show an article 40 having inner deflector 43, in addition to the deflector 44 which is integrated with the outer chamber wall 42. FIG. 4 shows a top view of the article 40. The inner deflector 43 is positioned within the residence chamber 54 at a radial distance shorter than that of the deflector 44, which forms outer chamber wall 42 with screen 46. To allow passage of the fluid stream within residence chamber 54, the inner deflector 43 will have a width and height that can be varied to control the flow direction within chamber 54. Alternatively or additionally, the inner deflector 43 may be provided with perforations to further vary the flow characteristics of the fluid stream within the residence chamber 54. When using a plurality of inner deflectors within the residence chamber, the deflectors can be positioned at varying radii about the axis of the article. The inner deflector 43 further increases the residence time of the fluid stream within the article, and thereby provides additional contact time with the foraminous catalytic element 46. As in catalytic article 10, article 40 includes a conduit 48 having an inlet 50 for receiving an exhaust gas and a plurality of spaced outlets 52 for directing the gas stream into residence chamber 54. Again, it is possible to provide catalytic components on deflector 44 or inner deflector 45, or both.

Figure 5:
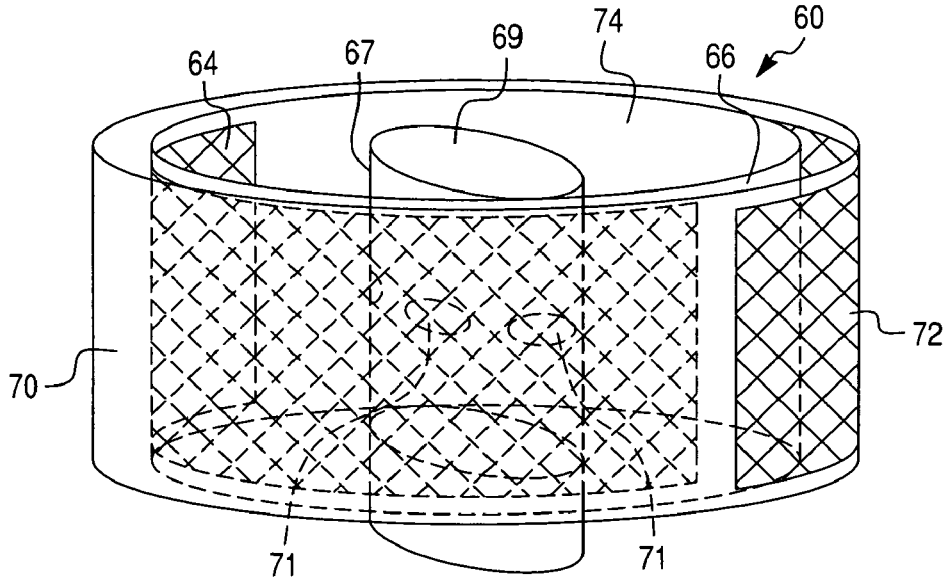
FIG. 5 illustrates another embodiment of the catalytic article comprising a plurality of annularly spaced circular gas residence chambers enclosed at least in part by chamber walls composed of a deflector plate and a foraminous catalytic element.
Figure 6:
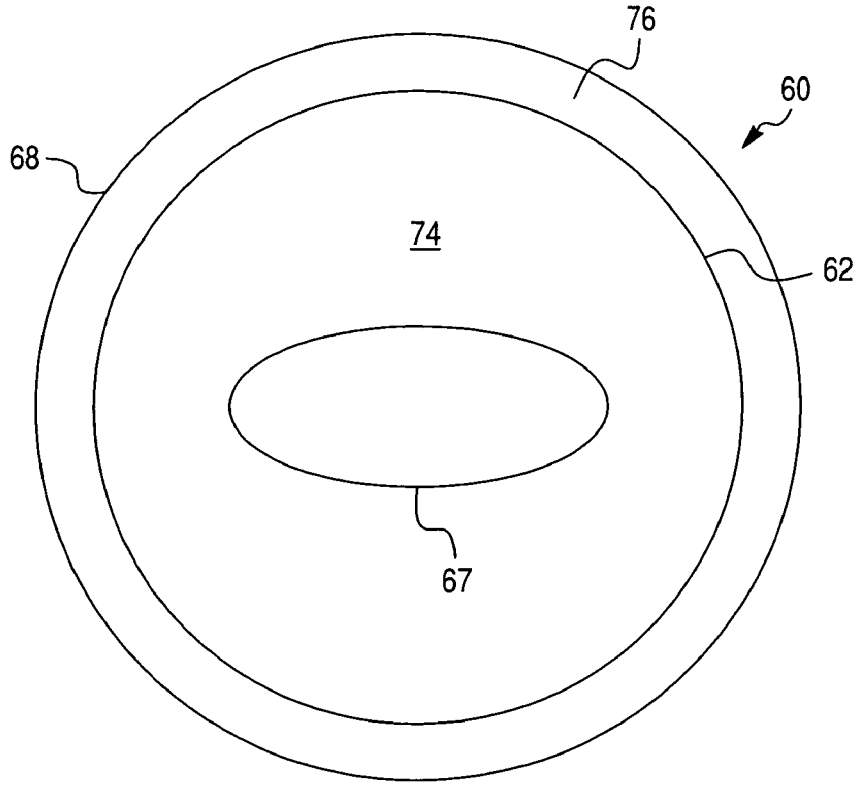
FIG. 6 shows a top view of the article of FIG. 5.

Another embodiment of the invention is illustrated in FIGS. 5 and 6. In this embodiment, the catalytic article 60 is in the form of a cylinder having a first chamber outer wall 62 composed of a foraminous catalytic element 64 and solid deflector plate 66. First chamber outer wall is annularly spaced from conduit 67 to form a first residence chamber 74. Peripheral to first chamber outer wall 62 and annularly spaced therefrom is a second chamber outer wall 68 formed of a deflector section 70, disposed at least in part across from foraminous catalytic element 64, and a foraminous catalytic element 72 disposed at least in part across from deflector plate 66. Conduit 67 has a conduit inlet 69 and a plurality of conduit outlets 71. Catalytic ariticle 60, thus, contains an inner residence chamber 74 defined at least in part by the outer wall of conduit 67 and first outer chamber wall 62 and an outer residence chamber 76 defined by first chamber outer wall 62 and second chamber outer wall 68. The inner residence chamber 74 and outer chamber 76 are further defined by a top wall and bottom wall (not shown) as illustrated in FIG. 2.

The outer residence chamber 76 communicates with the inner residence chamber 74 through the foraminous catalytic element 64. Gas flow from the outer residence chamber 76 to the exterior is through foraminous catalytic element 72. By circumferentially displacing screens 64 and 72 and deflector plates 66 and 70 from each other, gas flow in the respective residence chambers is slowed and residence time increased, allowing increased time for contact with the catalytic elements.

In operation, a fluid stream having an inlet space velocity enters the conduit inlet 69, and travels through the conduit 67 into the inner residence chamber 74, via the conduit outlets 71. In the inner residence chamber 74, the fluid stream contacts the foraminous element 64 to convert at least a portion of the reactants to product and then passes through the foraminous catalytic element 64 to the outer residence chamber 76. At least a portion of the fluid stream contacts deflector 66 to reduce gas space velocity and increase gas residence time within the inner residence chamber 74. A portion of the deflected fluid stream contacts the foraminous catalytic element 64 to convert at least some portion of the reactants to product. Gas entering outer chamber 76 is first deflected therein by deflector plate 70 to further reduce gas velocity before exiting through screen 72. The increased residence time in the inner and outer chambers provided through deflection by the respective deflectors increases the contact time of the fluid stream with the foraminous elements, and thereby increases the efficiency of the catalyst usage, as described above. Finally, the treated fluid stream exits the outer residence chamber 76 through the screen 72 and optionally into a muffler housing as shown in FIG. 1 before being exhausted to the environment.

The width of the outer residence chamber 76 can be adjusted by varying the proximity of the second chamber outer wall 68 to the first chamber outer wall 62. A variety of operating parameters influence the positioning of the screen 64 in relation to the foraminous catalytic element 72, including the space velocity of the fluid stream to be treated, the desired conversion of the reactants in the fluid stream and heat management requirements of the system in which the article is employed. The distance between the inner and outer chamber walls can also be optimized taking account of these factors. Such optimization can be conducted with a view toward the particular purpose the article is used for, and is within the purview of those of skill in the art.

In another variant of catalytic article 60, the inner chamber and/or outer chamber may contain one or more inner deflectors within the residence chambers as shown in FIG. 3. For instance, inner deflectors are positioned within the residence chamber at a radial distance from the article's axis that is shorter than that of the residence chamber outer walls to increase the residence time of the fluid stream within the article, analogous to the operation described with respect to FIGS. 3 and 4.

Figure 7:
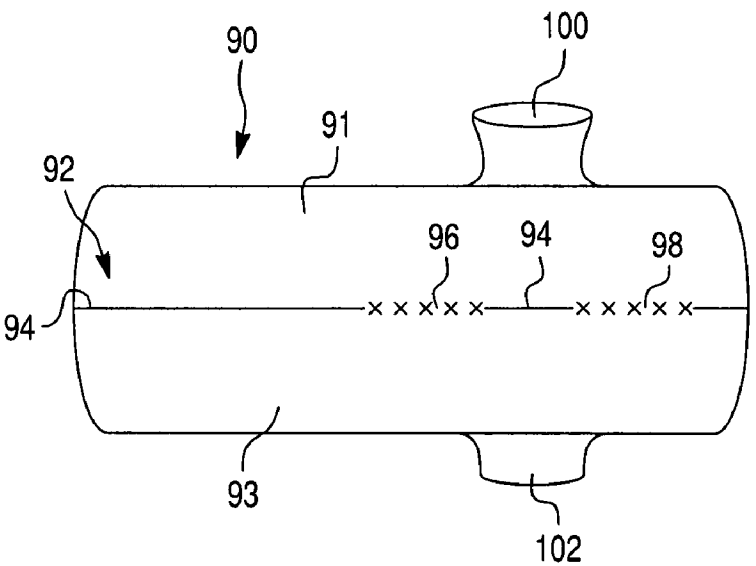
FIG. 7 is a sectional view of still another catalytic article with a rectilinear gas residence chamber enclosed at least in part by a linear chamber wall composed of a deflector surface and a foraminous catalytic element.

FIG. 7 illustrates an alternative embodiment of the invention and producing an overall lateral flow path of the fluid stream through the residence chamber, rather than a radial flow path. The article 90 has an upper rectilinear housing 91 and a lower rectilinear housing 93 which are divided from each other by a lateral chamber wall 92 formed with an integral deflector 94 and one or two foraminous catalytic elements 96 and 98 to provide a wall 92 formed by alternating deflector and foraminous surfaces. Upper housing 91 is provided with an inlet port 100 for receiving the fluid stream such as an exhaust gas from a gasoline powered engine. Lower housing 93 contains at least one outlet 102 for directing the treated gas to the environment. Thus gas entering upper housing 91 through inlet 100 is deflected laterally through upper housing 91 by contact with deflector surfaces 94. Gas placed in contact with screens 96 and/or 98 will be treated by contact with the catalytic elements, such as platinum group metals, coated onto screens 96 and 98. The deflector surfaces 94 reduce gas velocity and reduce contact time with catalytic screens 96 and 98. Gas directed into lower housing 93 through screens 96 and 98 is exhausted through outlet 102.

Figure 8:
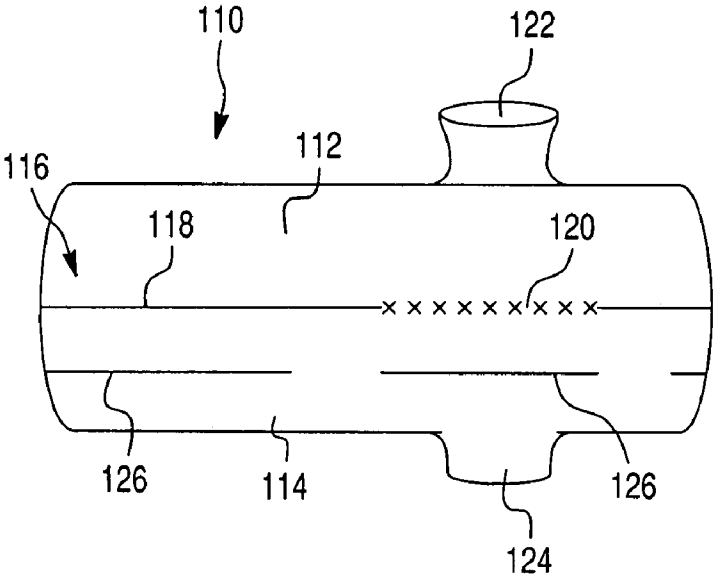
FIG. 8 is a sectional view of an alternative catalytic article to that of FIG. 7 in which a separate deflector plate is placed between the chamber wall and an outlet.

In a variant to the catalytic article shown in FIG. 7, catalytic article 110 in FIG. 8 also includes an upper rectilinear housing 112, a lower rectilinear housing 114, and a lateral chamber wall 116, which separates the upper and lower housings. Chamber wall 116 includes a deflector surface 118, which is divided by a catalytic foraminous element or screen 120. Although one section of chamber wall 116 includes the catalytic screen 120, it is possible to include additional sections of screen spaced along the chamber wall as equivalent to that shown in FIG. 7. Upper housing 112 includes an inlet 122 to receive exhaust gases from a gasoline powered engine, while lower housing 114 includes an outlet 124, which directs the treated gas to the environment. In the embodiment shown in FIG. 8, the lower housing 114 includes one or more deflector plates 126 positioned between the chamber wall 116 and the outlet 124. In operation, gas entering the upper housing 112 through inlet 122 passes through catalytic screen 120, wherein upon contact with screen 120, the reactants in the gas stream such as hydrocarbons, carbon monoxide, and NOx, are converted to more environmentally harmless molecules. A portion of the gas stream entering inlet 122 and housing 112 is deflected by deflector plate 118 into housing 112, thus reducing the velocity of the exhaust gas entering the upper housing 112 and prolonging the contact of the gas with the catalytic screen 120. A portion of the gas that passes through screen 120 will be directed immediately through outlet 124. However, a portion of the gas will be deflected back into screen 120 by deflector plates 126, which are disposed between the catalytic screen 120 and outlet 124. Again, the gas velocity in the lower housing 114 is reduced, and there is increased contact time of the gas with catalytic screen 120 to convert the reactants to more harmless components.

Methods for treating a fluid stream using articles of this design are analogous to the operation described supra for catalytic article 10.

In embodiments of the invention where the article is used to treat an exhaust gas stream from a gasoline engine, a muffler may house the article within an internal cavity of the muffler. The outlet of the article generally vents into a cavity inside the housing of a muffler as shown, for example, in FIG. 1. For instance, one muffler housing design that accommodates catalytic article 10 is a larger cylinder 30 in which the catalyst article is accommodated. The catalyst article can be, for example, mounted concentrically within the cylindrical muffler housing with the muffler housing having a diameter that is ½ to 1 inch larger than the diameter of the catalyst article. An exhaust port 32 can be provided at the top side of the muffler housing opposite the side accommodating the catalyst article.

In a preferred embodiment of the invention, the foraminous substrates are pretreated prior to deposition of the catalyst composition to improve the adherence of composition on the substrate. Pretreatment of the substrate can be conducted by applying a metal anchor layer to the substrate by known thermal spraying techniques before the catalyst slurry is applied. These techniques include plasma spraying, single wire spraying, high velocity oxy-fuel spraying, combustion wire and/or powder spraying, electric arc spraying etc. Preferably the metal anchor layer is applied by electric arc spraying.

Electric arc spraying, e.g., twin wire arc spraying, of a metal (which term, as used herein, includes mixtures of metals, including without limitation, metal alloys, pseudoalloys, and other intermetallic combinations) onto a metal foraminous substrate yields a structure having superior utility as a substrate for catalytic materials in the field of catalyst members. Twin wire arc spraying (encompassed herein by the term "wire arc spraying" and by the broader term "electric arc spraying") is a known process, as indicated by the above reference to U.S. Pat. No. 4,027,367 which is incorporated herein by reference. Briefly described, in the twin wire arc spray process, two feedstock wires act as two consumable electrodes. These wires are insulated from each other as they are fed to the spray nozzle of a spray gun in a fashion similar to wire flame guns. The wires meet in the center of a gas stream generated in the nozzle. An electric arc is initiated between the wires, and the current flowing through the wires causes their tips to melt. A compressed atomizing gas, usually air, is directed through the nozzle and across the arc zone, shearing off the molten droplets to form a spray that is propelled onto the substrate. Only metal wire feedstock can be used in an arc spray system because the feedstock must be conductive. The high particle temperatures created by the spray gun produce minute weld zones at the impact point on a metallic substrate. As a result, such electric arc spray coatings (sometimes referred to herein as "anchor layers") maintain a strong adhesive bond with the substrate.

Operating parameters for wire arc spraying for forming anchor layer on foraminous substrates are disclosed in copending U.S. patent application Ser. No. 09/301,626, filed Apr. 29, 1999 (the '626 application), now U.S. Publication No. 2002/0128151, published Sep. 12, 2002, the disclosure of which is hereby incorporated by reference in its entirety.

Anchor layers of a variety of compositions can be deposited on a substrate by utilizing, without limitation, feedstocks of the following metals and metal mixtures: Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels, and, optionally, mixtures of one or more thereof. One specific example of a metal useful for wire arc spraying onto a substrate in accordance with the '626 application is a nickel/aluminum alloy that generally contains at least about 90% nickel and from about 3% to 10% aluminum, preferably from about 4% to 6% aluminum by weight. Such an alloy may contain minor proportions of other metals referred to herein as "impurities" totaling not more than about 2% of the alloy. A preferred specific feedstock alloy comprises about 95% nickel and 5% aluminum and may have a melting point of about 2642° F. Some such impurities may be included in the alloy for various purposes, e.g., as processing aids to facilitate the wire arc spraying process or the formation of the anchor layer, or to provide the anchor layer with favorable properties.

Electric arc spraying a metal onto a metal substrate yields a superior substrate for catalytic materials relative to substrates having metal anchor layers applied thereto by other methods. Catalytic materials have been seen to adhere better to a substrate comprising an electric arc sprayed anchor layers than to a substrate without an intermediate layer applied thereto and even better than to a substrate having a metal layer deposited thereon by plasma spraying. Catalytic materials disposed on metal substrates, without intermediate layers between the substrate and the catalytic material, often did not adhere sufficiently well to the substrate to provide a commercially acceptable product. Metal substrates having an intermediate layer applied by other thermal spraying techniques typically suffer the same drawbacks. For example, a metal substrate having a metal intermediate layer that was plasma-sprayed thereon and having a catalytic material applied to the intermediate layer failed to retain the catalytic material, which flaked off upon routine handling, apparently due to a failure of the intermediate layer to bond with the substrate. The catalytic material on other substrates was seen to spall off upon normal use, apparently as a result of being subjected to a high gas flow rate, to thermal cycling, to the eroding contact of high temperature steam and other components of the exhaust gas stream, vibrations, etc. Application of the intermediate layer by electric arc spraying therefore improves the durability of catalyst members comprising catalytic materials carried on foraminous substrates by improving their durability.

Substrates (also referred to herein as foraminous substrates) useful for forming the foraminous catalytic elements include those metallic substrates which are able to accommodate a high flow rate (preferably >20,000 L/h for a 50 cc engine), are lightweight, have a low thermal mass. Preferably, the surfaces of the substrates are suitable for application of a metal anchor layer. For instance, the substrate can be perforated metal foil, sintered metals, woven wire mesh or non-woven wire mesh.

A preferred substrate is woven or non-woven wire mesh. A woven wire mesh substrate for use with the present invention may be formed in any suitable weave, e.g., plain, twill, plain Dutch weave, twill Dutch weave, crocheting, etc. Wire mesh is commonly available in weaves that leave from about 18 to 78 percent open area, more typically, from about 30 to 70 percent open area. "Open area" is known in the art as a measure of total mesh area that is open space. Mesh counts (the number of openings in a lineal inch) for such materials vary from two per inch by two per inch (2×2) to 635×635. The mesh may be woven from wires comprising aluminum, brass, bronze, copper, nickel, stainless steel, titanium, etc., and combinations and alloys thereof. A non-woven wire mesh that can be used as an open substrate in accordance with this invention may be made from the same materials as woven mesh. A wire mesh substrate may comprise one or more layers of wire mesh joined together by soldering, welding or any other suitable method.

Wire mesh substrates are particularly useful in devices powered by small engines. First, the screens are lightweight so that the catalyst article contributes only negligible weight to the device. Second, the screens have a relatively low thermal mass as compared to bulkier substrates. This property allows the substrate to heat up to temperatures quickly at startup, and also allows the substrate to cool down quickly when the device is shutdown. Achieving effective operating temperatures of the catalyst composition quickly is important to secure rapid conversions of pollutants. A long lag time between the startup of the device and the initiation of pollutant combustion leads to significant emissions of untreated pollutants to the atmosphere.

Third, the distribution of the catalyst composition on the screen reduces the propensity for forming hot spots within the catalytic article. The formation of hot spots within the catalytic article can result in the detrimental transfer of heat from the article to the engine cylinder.

Finally, the screen structure creates a turbulent flow of the fluid stream within the catalyst article. Increased turbulence facilitates mixing of the exhaust gases (e.g., with oxygen) and improves the contact with the catalyst composition deposited on the screen.

Perforated metal foils can also be used as the foraminous substrates. These substrates can be formed from high temperature resistive, oxidation resistant (and corrosion resistant) metal alloys. Suitable metal alloys can preferably withstand "high" temperatures, e.g., from 900° C. to 1200° C. over prolonged periods.

For instance, the foil may be constructed from "ferritic" stainless steel such as that described in U.S. Pat. No. 4,414,023 to Aggen. One usable ferritic stainless steel alloy contains 20% chromium, 5% aluminum, and from 0.002% to 0.05% of at least one rare earth metal selected from cerium, lanthanum, neodymium, yttrium, and praseodymium, or a mixture of two or more of such rare earth metals, balance iron and trace steel making impurities. A ferritic stainless steel is commercially available from Allegheny Ludlum Steel Co. under the trade designation "Alfa IV."

Another usable commercially available stainless steel metal alloy is identified as Haynes 214 alloy. This alloy and other useful nickeliferous alloys are described in U.S. Pat. No. 4,671,931 to Herchenroeder et al. These alloys are characterized by high resistance to oxidation and high temperatures. A specific example contains 75% nickel, 16% chromium, 4.5% aluminum, 3% iron, optionally trace amounts of one or more rare earth metals except yttrium, 0.05% carbon, and steel making impurities. Still another suitable alloy is Haynes 230 alloy, which contains 22% chromium, 14% tungsten, 2% molybdenum, 0.10% carbon, a trace amount of lanthanum, balance nickel.

Foraminous substrates, which have been treated by having an anchor layer deposited by electric arc spraying, can be mechanically processed in various ways that reshape the substrate but that do not diminish the mass of the substrate, i.e., they do not involve cutting, grinding or other removal of substrate material. For example, pliable (i.e., malleable and/or flexible) anchor layer-coated substrates may be bent, compressed, folded, rolled, woven, etc., after the anchor layer is deposited thereon, in addition to or instead of being cut, ground, etc. As used herein, the term "reshape" is meant to encompass all such processes that deform the substrate but do not reduce its mass by cutting, grinding, etc. Such techniques can increase the available surface area through which the fluid stream passes though before exiting the article. Thus, a wire arc-sprayed foil substrate can be reshaped by being corrugated and rolled with a flat foil to provide a corrugated foil honeycomb. A wire can be reshaped by being sprayed and then woven with other wires to compose a mesh that is used as a substrate for a catalytic material. Similarly, a flat wire mesh substrate that has been wire arc sprayed to coat with an anchor layer can then be reshaped by being curled into a cylindrical configuration or by being formed into a corrugated sheet.

A suitable catalytic material for use on a foraminous substrate can be prepared by dispersing a compound and/or complex of any catalytically active component, e.g., one or more platinum group metal compounds or complexes, onto relatively inert bulk support material. As used herein, the term "compound", as in "platinum group metal compound" means any salt, complex, or the like of a catalytically active component (or "catalytic component") which, upon calcination or upon use of the catalyst, decomposes or otherwise converts to a catalytically active form, which is often, but not necessarily, an oxide. The compounds or complexes of one or more catalytic compounds may be dissolved or suspended in any liquid which will wet or impregnate the support material, which does not adversely react with other components of the catalytic material and which is capable of being removed from the catalyst by volatilization or decomposition upon heating and/or the application of a vacuum. Generally; both from the point of view of economics and environmental aspects, aqueous solutions of soluble compounds or complexes are preferred. For example, suitable water-soluble platinum group metal compounds are chloroplatinic acid, amine solubilized platinum hydroxide, rhodium chloride, rhodium nitrate, hexamine rhodium chloride, palladium nitrate or palladium chloride, etc. The compound-containing liquid is impregnated into the pores of the bulk support particles of the catalyst, and the impregnated material is dried and preferably calcined to remove the liquid and bind the platinum group metal into the support material. In some cases, the completion of removal of the liquid (which may be present as, e.g., water of crystallization) may not occur until the catalyst is placed into use and subjected to the high temperature exhaust gas. During the calcination step, or at least during the initial phase of use of the catalyst, such compounds are converted into a catalytically active form of the platinum group metal or a compound thereof. An analogous approach can be taken to incorporate the other components into the catalytic material. Optionally, the inert support materials may be omitted and the catalytic material may consist essentially of the catalytic component deposited directly on the sprayed foraminous substrate by conventional methods.

Preferred platinum group metal components for use in the articles of the invention include platinum, palladium, rhodium, ruthenium and iridium components. Platinum, palladium and rhodium components are particularly preferred. When deposited on a foraminous substrate (e.g., metal screen) such components are generally deposited at a concentration of from 0.001 to 0.01 g/in$^2$ for typical utility engine applications.

Suitable support materials for the catalytic component include alumina, silica, titania, silica-alumina, alumino-silicates, aluminum-zirconium oxide, aluminum-chromium oxide, etc. Such materials are preferably used in their high surface area forms. For example, gamma-alumina is preferred over alpha-alumina. It is known to stabilize high surface area support materials by impregnating the material with a stabilizer species. For example, gamma-alumina can be stabilized against thermal degradation by impregnating the material with a solution of a cerium compound and then calcining the impregnated material to remove the solvent and convert the cerium compound to a cerium oxide. The stabilizing species may be present in an amount of from about, e.g., 5 percent by weight of the support material. The catalytic materials are typically used in particulate form with particles in the micron-sized range, e.g., 10 to 20 microns in diameter, so that they can be formed into a slurry and coated onto a substrate.

A typical catalytic material for use on a catalyst member for a small engine comprises platinum, palladium and rhodium dispersed on an alumina and further comprises oxides of neodymium, strontium, lanthanum, barium and zirconium. Some suitable catalysts are described in U.S. patent application Ser. No. 08/761,544 filed Dec. 6, 1996, the disclosure of which is incorporated herein by reference. In one embodiment described therein, a catalytic material comprises a first refractory component and at least one first platinum group component, preferably a first palladium component and optionally, at least one first platinum group metal component other than palladium, an oxygen storage component which is preferably in intimate contact with the platinum group metal component in the first layer. An oxygen storage component ("OSC") effectively absorbs excess oxygen during periods of lean engine operation and releases oxygen during periods of fuel-rich engine operation and thus ameliorates the variations in the oxygen/hydrocarbon stoichiometry of the exhaust gas stream due to changes in engine operation between a fuel-rich operation mode and a lean (i.e., excess oxygen) operation mode. Bulk ceria is known for use as a OSC, but other rare earth oxides may be used as well. In addition, as indicated above, a co-formed rare earth oxide-zirconia may be employed as a OSC. The co-formed rare earth oxide-zirconia may be made by any suitable technique such as co-precipitation, co-gelling or the like. One suitable technique for making a co-formed ceria-zirconia material is illustrated in the article by Luccini, E., Mariani, S., and Sbaizero, O. (1989) "Preparation of Zirconia Cerium Carbonate in Water With Urea" Int. J. of Materials and Product Technology, vol. 4, no. 2, pp. 167-175, the disclosure of which is incorporated herein by reference. As disclosed starting at page 169 of the article, a dilute (0.1 M) distilled water solution of zirconyl chloride and cerium nitrate in proportions to promote a final product of $ZrO_2$-10 mol % $CeO_2$ is prepared with ammonium nitrate as a buffer, to control pH. The solution was boiled with constant stirring for two hours and complete precipitation was attained with the pH not exceeding 6.5 at any stage.

Any suitable technique for preparing the co-formed rare earth oxide-zirconia may be employed, provided that the resultant product contains the rare earth oxide dispersed substantially throughout the entire zirconia matrix in the finished product, and not merely on the surface of the zirconia particles or only within a surface layer, thereby leaving a substantial core of the zirconia matrix without rare earth oxide dispersed therein. Thus, co-precipitated zirconium and cerium (or one other rare earth metal) salts may include chlorides, sulfates, nitrates, acetates, etc. The co-precipitates may, after washing, be spray dried or freeze dried to remove water and then calcined in air at about 500° C. to form the co-formed rare earth oxide-zirconia support. The catalytic materials of aforesaid application Ser. No. 08/761,544 may also include a first zirconium component, at least one first alkaline earth metal component, and at least one first rare earth metal component selected from the group consisting of lanthanum metal components and neodymium metal components. The catalytic material may also contain at least one alkaline earth metal component and at least one rare earth component and, optionally, at least one additional platinum group metal component preferably selected from the group consisting of platinum, rhodium, ruthenium, and iridium components with preferred additional first layer platinum group metal components being selected from the group consisting of platinum and rhodium and mixtures thereof.

Another preferred catalytic material contains a platinum group metal component comprising platinum and rhodium dispersed on a refractory oxide support component comprising alumina, co-formed ceria-zirconia, baria and zirconia. The preparation of this catalytic material is exemplified in Example 1 (below).

A variety of deposition methods are known in the art for depositing catalytic material on a foraminous substrate. These methods of applying the catalytic component onto the substrate constitute a separate step in the manufacturing process relative to the application of any anchor layer (if applied) to the substrate.

Methods for depositing catalytic material on the foraminous substrate include, for example, disposing the catalytic material in a liquid vehicle to form a slurry and wetting the foraminous substrate with the slurry by dipping the substrate into the slurry, spraying the slurry onto the substrate, etc. Alternatively, the catalytic material may be dissolved in a solvent and the solvent may then be wetted onto the surface of the foraminous substrate and thereafter removed to leave the catalytic material, or a precursor thereof, on the foraminous substrate. The removal procedure may entail heating the wetted substrate and/or subjecting the wetted substrate to a vacuum to remove the solvent via evaporation.

Another method for depositing a catalytic material onto the foraminous substrate is to provide the catalytic material in powder form and adhere it to the substrate via electrostatic deposition. This method would be appropriate for producing a catalyst member for use in liquid phase chemical reactions.

The following examples further illustrate the present invention, but of course, should not be construed as in any way limiting its scope.

EXAMPLE 1

Preparation of Catalyst Composition Containing Platinum and Rhodium in a 5:1 Ratio A preferred catalyst composition useful for certain catalyst articles of the invention contains platinum and rhodium components in about at 5:1 ratio (by weight). The composition is prepared as described below.

First, platinum and rhodium compounds are dispersed on to a high surface area (150 $m^2/g$), gamma alumina support. An aqueous slurry of the alumina (97% solids, 3079 g) is impregnated with an aqueous solution containing 74 g of amine-solubilized platinum hydroxide. Thereafter, the slurry is impregnated with an aqueous solution containing 14.7 g of rhodium nitrate. The slurry is combined with a mixture of octanol (0.3% by weight based on the total solids), 90% acetic acid and water. The resulting slurry (47% by weight solids) is mixed and ball-milled so that the 90% of the particles have a particle size of 12 microns or less.

An aqueous slurry containing ceria-zirconia composite material (containing about a 50:50 weight ratio of ceria to zirconia, 2329 g), zirconium acetate (238 g), barium acetate (299 g) and acetic acid is added to the above-milled slurry. The resulting slurry (47% by weight solids) is mixed and milled so that the 90% of the particles have a particle size of 7 microns or less. An aqueous mixture of pseudoboehmite (60 g) is added to the resulting milled slurry to give a coating slurry containing 45% by weight of solids.

EXAMPLE 2

Preparation of Cylindrical Catalyst Article having Deflector Plate and Wire Mesh Foraminous Catalytic Substrate To prepare an article having the design as shown in FIG. 1, a stainless steel metal screen (12 mesh, 36 mm×90 mm) was wire arc spray-coated with a nickel-aluminide alloy as described in Example 1 of the aforesaid '626 application. The screen substrate was then coated with the coating slurry described above (Example 1) at a washcoat loading of 0.05 to 0.1 $g/in^2$. The screen was then rolled into a semi-circle and fitted into a diffuser block (conduit) and lower wall assembly. The upper wall assembly is then crimped over the screen and a stainless-steel, semicircular deflector is welded on the side of the catalytic article opposite the metal screen.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed is:

1. A method for treating a fluid stream having a reactant comprising:

(a) injecting the fluid stream at an injection space velocity into a residence chamber, comprising a chamber outer wall in the form of a cylinder, wherein a first part of the cylindrical chamber outer wall comprises a foraminous catalytic element and a second part of said cylindrical chamber outer wall comprises a solid deflector plate;

(b) deflecting at least a portion of the fluid stream with the deflector plates to reduce the space velocity of the fluid stream through the residence chamber; and, (c) contacting the fluid stream with the foraminous catalytic element to convert at least some of the reactant to product to form a treated fluid stream; and (d) passing the treated fluid stream though the foraminous catalytic element.

2. The method of claim 1 wherein the fluid stream to be treated comprises a reactant selected from the group consisting of unburned hydrocarbon, carbon monoxide, NOx, and mixtures thereof.

3. A catalytic article comprising:

a residence chamber defined at least by a chamber outer wall in the form of a cylinder wherein a first part of the cylindrical chamber outer wall comprises a foraminous catalytic element and a second part of the cylindrical chamber outer wall comprises a solid deflector, and means to direct a gas stream into said residence chamber, said cylindrical chamber outer wall positioned whereby a first portion of said gas stream passes directly from said means to direct a gas stream through said foraminous catalytic element and a second portion of said gas passes directly from said means to direct a gas stream against said solid deflector, said solid deflector redirecting said second portion back into said residence chamber thereby increasing the residence time of said second portion of said gas in said residence chamber.

4. The article of claim 3 wherein at least part of said solid deflector is coated with a catalytic element.

5. The article of claim 3 wherein said residence chamber is further defined by a first wall and a second wall, which along with said cylindrical chamber outer wall enclose the residence chamber.

6. The article of claim 3, wherein the foraminous catalytic element comprises woven or non-woven wire mesh, sintered metal or perforated metal foil.

7. The article of claim 6, comprising an anchor layer interposed between the foraminous catalytic element and a catalyst composition.

8. The article of claim 3, wherein the foraminous catalytic element comprises a catalyst composition with at least one platinum group metal component.

9. The article of claim 8 wherein the at least one platinum group metal component is disposed on a refractory metal oxide having a BET surface area of at least 50 $m^2/g$ in the catalyst composition.

10. A muffler with a housing that encloses an interior cavity, said cavity containing the article of claim 3.

11. An exhaust system comprising a gasoline-powered engine and the muffler of claim 10 communicating with said engine.

12. The article of claim 3 wherein said means to direct a gas stream is a conduit comprising at least one conduit wall having a conduit inlet for receiving a gas stream and at least one conduit outlet for directing said gas stream into said residence chamber.

13. The article of claim 12 wherein said residence chamber is defined by said chamber outer wall and said conduit wall.

14. The article of claim 13 wherein said residence chamber is an annular space between said conduit wall and said chamber outer wall.

15. The article of claim 14, wherein the residence chamber further comprises an inner deflector radially spaced from said chamber outer wall and located within said annular space.

16. The article of claim 3 comprising a first residence chamber defined at least by said chamber outer wall and further comprising a second residence chamber defined by a second chamber outer wall wherein a first part of said second chamber outer wall comprises a foraminous catalytic element and a second part of said second chamber outer wall comprises a solid deflector, said second residence chamber communicating with said first residence chamber through the foraminous catalytic element of said chamber outer wall.

17. The article of claim 16 wherein said second chamber outer wall is in the form of a cylinder, said second chamber outer wall being radially spaced from said chamber outer wall such that said second residence chamber is an annular space between said first chamber outer wall and said second chamber outer wall.

18. The article of claim 16 wherein said foraminous catalytic element of said first chamber outer wall is radially spaced from and at least in part directly opposed to said solid deflector of said second chamber outer wall.

* * * * *